US012577019B2

(12) United States Patent
Walton et al.

(10) Patent No.: US 12,577,019 B2
(45) Date of Patent: Mar. 17, 2026

(54) STORAGE BIN AND LID

(71) Applicant: YUM Connect, LLC, Louisville, KY (US)

(72) Inventors: Eric Matthew Walton, Frisco, TX (US); Shelby Alexis Stanfield, McKinney, TX (US); Peter Gerald Graham, Lucas, TX (US)

(73) Assignee: Yum Connect, LLC, Louisville, KY (US)

( * ) Notice: Subject to any disclaimer, the term of this patent is extended or adjusted under 35 U.S.C. 154(b) by 0 days.

(21) Appl. No.: 18/532,677

(22) Filed: Dec. 7, 2023

(65) Prior Publication Data

US 2024/0190611 A1 Jun. 13, 2024

Related U.S. Application Data

(60) Provisional application No. 63/387,030, filed on Dec. 12, 2022.

(51) Int. Cl.
*B65D 21/02* (2006.01)

(52) U.S. Cl.
CPC ..... *B65D 21/0215* (2013.01)

(58) Field of Classification Search
CPC . B65D 21/0215; B65D 21/02; B65D 21/0209
USPC ..... 206/511
See application file for complete search history.

(56) References Cited

U.S. PATENT DOCUMENTS 3,140,007 A * 7/1964 Nettleship ..... B01L 3/508 206/508
4,485,924 A * 12/1984 Ripoll ..... B65D 7/06 206/508
D280,058 S 8/1985 Carlson
4,844,263 A * 7/1989 Hadtke ..... B65D 21/022 206/508
5,249,684 A * 10/1993 Sterett ..... B65D 21/0215 220/23.6

(Continued)

FOREIGN PATENT DOCUMENTS

JP 3131449 U 5/2007

OTHER PUBLICATIONS

PCT International Search Report and Written Opinion for Application No. PCT/US2023/082950 mailing date Apr. 2, 2024, 11 pages.

(Continued)

*Primary Examiner* — Ernesto A Grano
*Assistant Examiner* — Symren K Sanghera
(74) *Attorney, Agent, or Firm* — Foley & Lardner LLP

(57) ABSTRACT

A storage system is provided that includes a stadium shaped bin having a bottom and an outer wall adjacent and extending from an outer edge of the bottom. The bottom and the outer wall defining an inner storage area. The bin having a plurality of legs located on a lower side of the bottom of the bin. The storage system further includes a lid having a raised top-hat portion about an upper surface and a skirt about an outer edge of the lid. The lid sized such that the skirt extends over the outer wall of the bin when the lid is placed on the bin, wherein the legs of the bin and raised top-hat portion of the lid are sized so that the legs nest about the raised top-hat portion of the lid when the bin is placed on the lid.

20 Claims, 6 Drawing Sheets

(56) References Cited

U.S. PATENT DOCUMENTS

| | | | | |
|---|---|---|---|---|
| 5,383,557 | A * | 1/1995 | Weisburn | G11B 23/0233 206/387.13 |
| 5,667,065 | A * | 9/1997 | Fahrion | B65D 21/0215 206/599 |
| D491,288 | S | 6/2004 | Young | |
| D501,636 | S | 2/2005 | Melhede | |
| D563,157 | S | 3/2008 | Bouveret et al. | |
| D591,111 | S | 4/2009 | Rzeczkowski | |
| D592,499 | S | 5/2009 | Colacitti | |
| D594,325 | S | 6/2009 | Colacitti | |
| 8,544,648 | B2 * | 10/2013 | Cleveland | B65D 45/22 220/592.2 |
| 8,590,704 | B2 * | 11/2013 | Koenig | B65D 21/0228 206/508 |
| D696,111 | S | 12/2013 | Sundy et al. | |
| D699,568 | S | 2/2014 | Epstein et al. | |
| D706,131 | S | 6/2014 | Brooks et al. | |
| D712,703 | S | 9/2014 | Lipinski et al. | |
| D790,088 | S | 6/2017 | Yeffet | |
| D803,676 | S | 11/2017 | Fisher et al. | |
| D811,882 | S | 3/2018 | Gundersen | |
| D944,640 | S | 3/2022 | Wu | |
| D947,020 | S | 3/2022 | Drolet | |
| D967,702 | S | 10/2022 | Roman et al. | |
| D988,805 | S | 6/2023 | Du | |
| D991,784 | S | 7/2023 | Stewart et al. | |
| 11,801,971 | B2 * | 10/2023 | Yen | B65D 25/24 |
| D1,010,439 | S | 1/2024 | Stewart et al. | |
| 2004/0118737 | A1 | 6/2004 | Welsh et al. | |
| 2010/0006467 | A1 * | 1/2010 | Joseph | B65D 43/0216 206/508 |
| 2014/0305829 | A1 * | 10/2014 | Roesler | B25H 3/021 206/511 |
| 2014/0332546 | A1 * | 11/2014 | Connard | B08B 17/025 220/789 |
| 2015/0101955 | A1 * | 4/2015 | Lam | B65D 21/0223 220/601 |
| 2019/0135488 | A1 * | 5/2019 | Douralis | B65D 88/126 |
| 2020/0102142 | A1 * | 4/2020 | Dowd | B65D 81/263 |
| 2021/0130060 | A1 | 5/2021 | Goad et al. | |
| 2021/0229890 | A1 * | 7/2021 | Guirguis | B65D 43/0208 |
| 2022/0267050 | A1 | 8/2022 | Yen et al. | |
| 2022/0371776 | A1 * | 11/2022 | Sommer | B65D 43/021 |
| 2024/0190611 | A1 * | 6/2024 | Walton | B65D 43/0212 |
| 2024/0286793 | A1 * | 8/2024 | Dowd | B65D 81/263 |

OTHER PUBLICATIONS

Ex Parte Quayle Action on U.S. Appl. No. 29/868,270 DTD Mar. 24, 2025.

Notice of Allowance on U.S. Appl. No. 29/868,270 DTD Jun. 10, 2025.

PCT Int Preliminary Report and WO dtd Jun. 26, 25 re PCT/US2023/082950.

Superio Food Storage Container. Online, published date Aug. 10, 2023. Retrieved on Mar. 12, 2025 from URL: https://www.amazon.com/ Superio-Containers-Airtight-Rectangle-Mi crowave/dp/B0756LHDRD/.

Take Out Box. Online, published date Jan. 6, 2015. Retrieved on Mar. 12, 2025 from URL: https://www.istockphoto.com/photo/ take-out-box-g m531083313-55073280.

Tidtaleo Ice Cream Container. Online, published date Nov. 19, 2023. Retrieved on Mar. 12, 2025 from URL: https://www.amazon.in/ TI OTALEO-freezer-containers-Container-Practical/dp/BOCDVGG6JQ.

* cited by examiner

STORAGE BIN AND LID

CROSS-REFERENCE TO RELATED APPLICATIONS

This application claims priority to U.S. Provisional Application No. 63/387,030 filed Dec. 12, 2022 entitled, "Storage Bin and Lid", which is incorporated by reference herein as if reproduced in its entirety.

STATEMENT REGARDING FEDERALLY SPONSORED RESEARCH OR DEVELOPMENT

Not applicable.

REFERENCE TO A MICROFICHE APPENDIX

Not applicable.

BACKGROUND

It may be useful to store items in containers or storage bins. Storage bins may vary in size to accommodate the size of the items to be stored. Storage bin configurations may also need to consider the particular characteristics of the items to be stored in the storage bin.

SUMMARY

In one embodiment, a storage system is provided that includes a stadium shaped bin having a bottom and an outer wall adjacent and extending from an outer edge of the bottom. The bottom and the outer wall defining an inner storage area. The bin having a plurality of legs located on a lower side of the bottom of the bin. The storage system further includes a lid having a raised top-hat portion about an upper surface and a skirt about an outer edge of the lid. The lid sized such that the skirt extends over the outer wall of the bin when the lid is placed on the bin, wherein the legs of the bin and raised top-hat portion of the lid are sized so that the legs nest about the raised top-hat portion of the lid when the bin is placed on the lid.

In one embodiment, a system is provided that includes a plurality of storage systems including at least a first and a second storage system. Each of the plurality of storage systems include a stadium shaped bin having a bottom and an outer wall adjacent and extending from an outer edge of the bottom, the bottom and the outer wall defining an inner storage area, the bin having a plurality of legs located on a lower side of the bottom of the bin. Each of the plurality of storage systems further include a lid having a raised top-hat portion about an upper surface and a skirt about an outer edge of the lid. The lid sized such that the skirt extends over the outer wall of the bin when the lid is placed on the bin, wherein the legs of the bin and raised top-hat portion of the lid are sized so that the plurality of legs of either the first or second storage system nest about the raised top-hat portion of the lid of the other of the first or second storage system when the first or second storage system is on top of the lid of the other of the first or second storage system.

These and other features will be more clearly understood from the following detailed description taken in conjunction with the accompanying drawings and claims.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

It should be understood at the outset that although illustrative implementations of one or more embodiments are illustrated below, the disclosed systems and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents.

Figure 1:
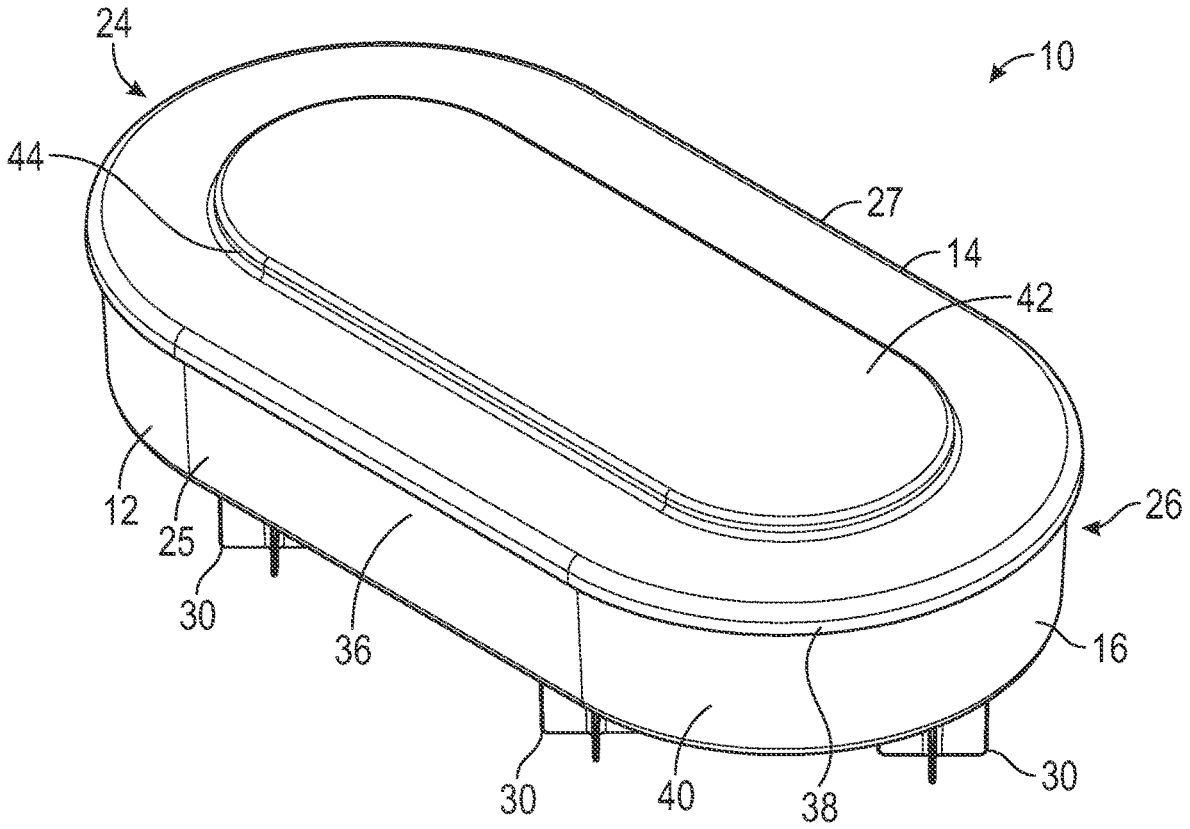
FIG. 1 is a top perspective view of a storage bin with a lid according to one embodiment of the present disclosure.
Figure 2:
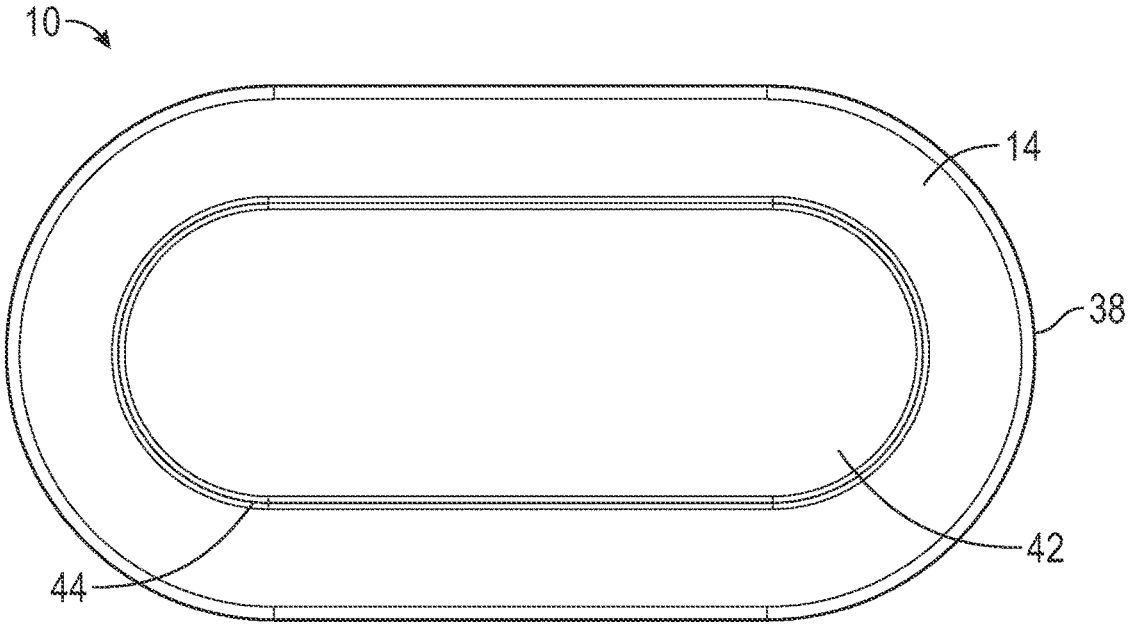
FIG. 2 is a top view of the storage bin with the lid illustrated in FIG. 1 according to one embodiment of the present disclosure.
Figure 3:
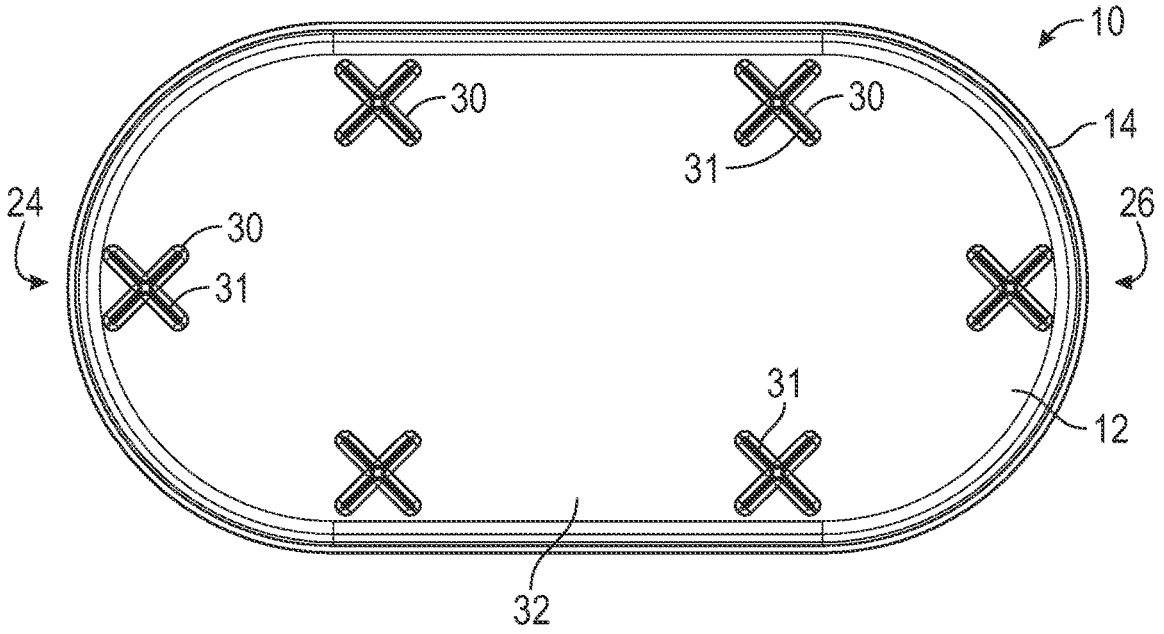
FIG. 3 is a bottom view of the storage bin with the lid illustrated in FIG. 1 according to one embodiment of the present disclosure.
Figure 4:
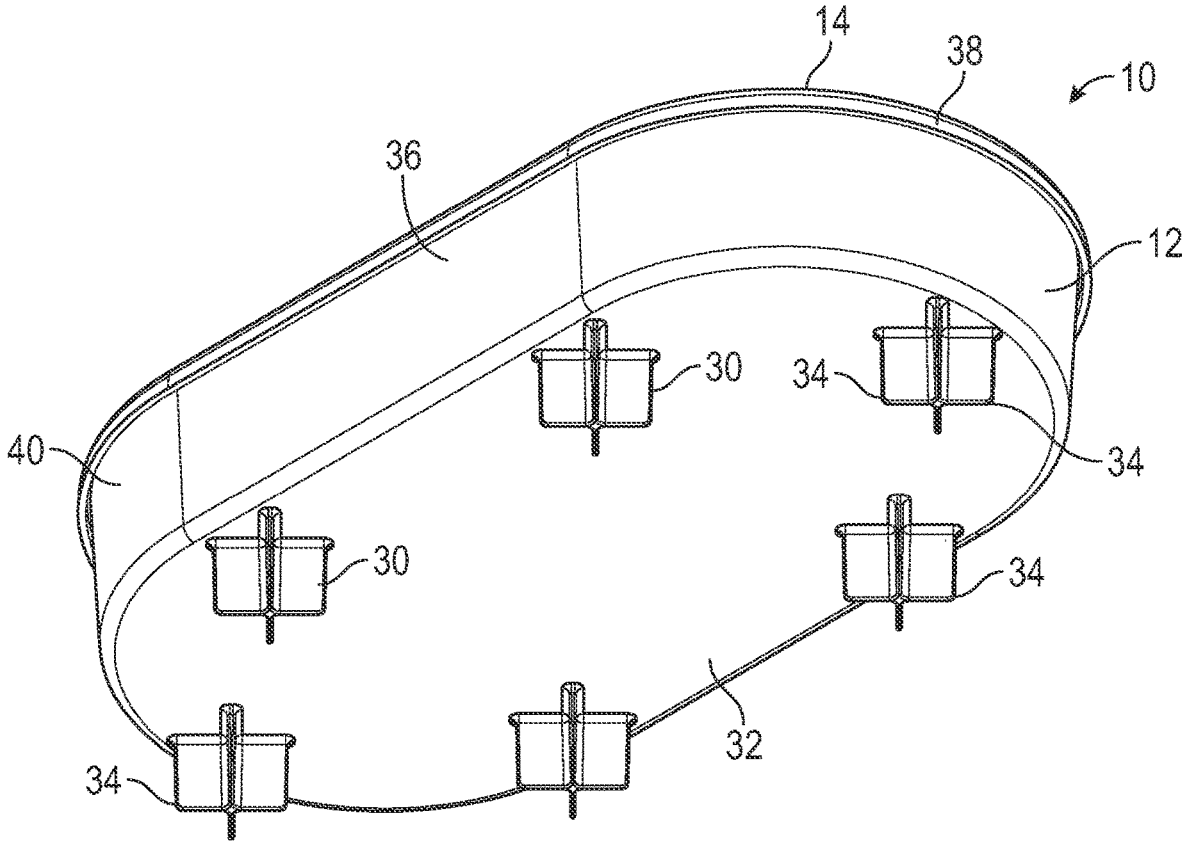
FIG. 4 is a bottom perspective view of the storage bin with the lid illustrated in FIG. 1 according to one embodiment of the present disclosure.
Figure 5:
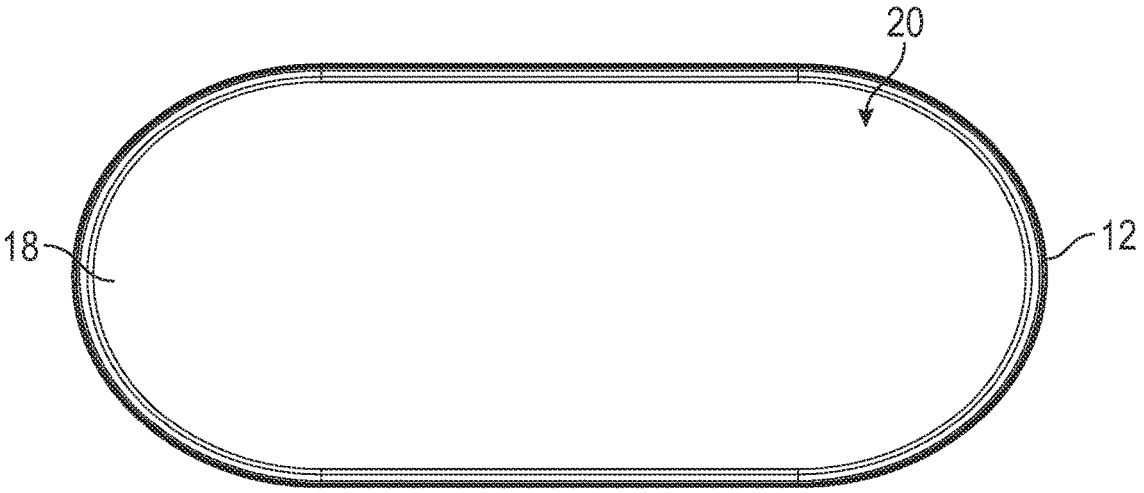
FIG. 5 is a top view of the storage bin without the lid according to one embodiment of the present disclosure.
Figure 6:
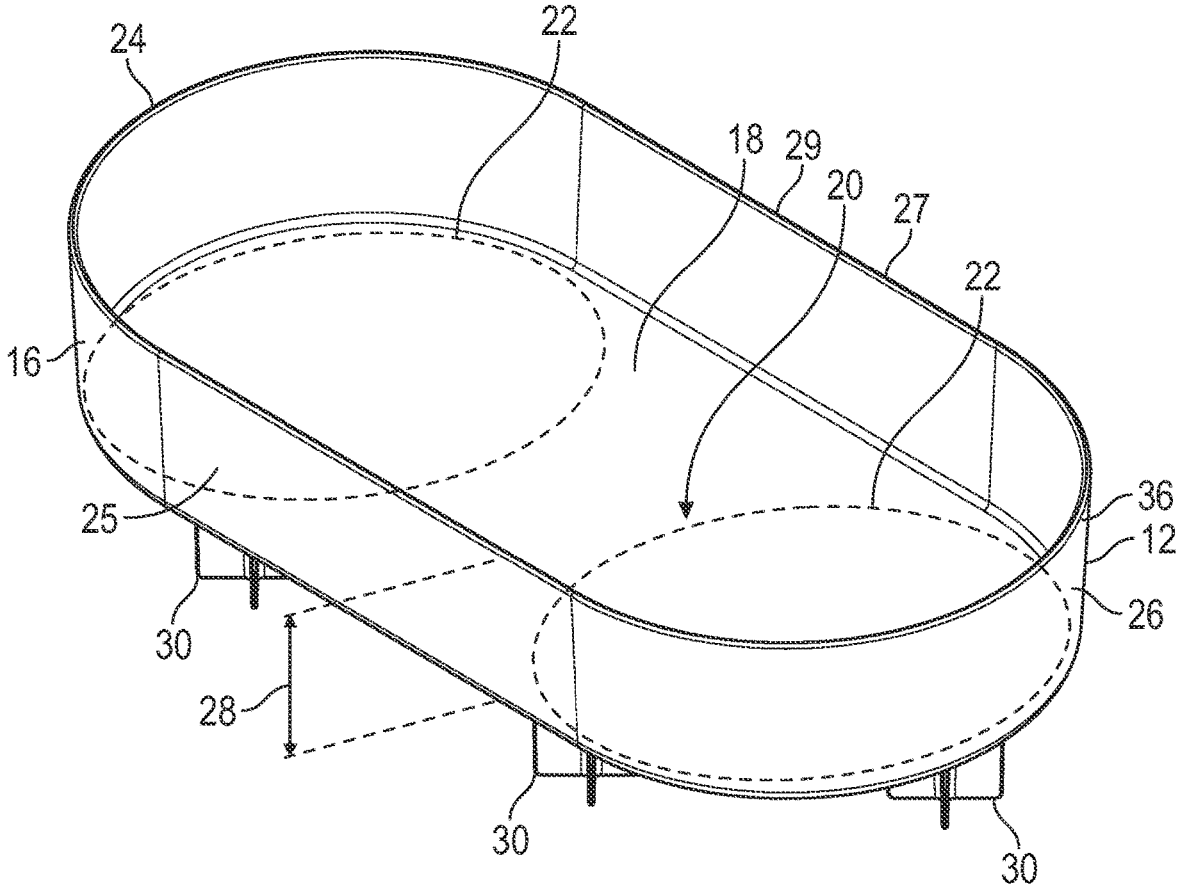
FIG. 6 is a top perspective view of the storage bin without the lid according to one embodiment of the present disclosure.

FIGS. 1-4 illustrate embodiments of a storage system 10 that includes a storage bin 12 and a lid 14. The storage bin 12 and lid 14 are generally stadium or obround shaped in the present embodiment, but other shapes may be used in other embodiments. As can be seen in FIGS. 5 and 6, the storage bin 12 includes an outer wall 16 extending from a bin bottom 18 that defines a storage area 20. The overall dimensions of the storage system 10 may vary in different embodiments depending upon the items to be stored therein. In the present embodiment, the storage system 10 may be sized to accommodate multiple round objects, such as pizza dough 22. Accordingly, first and second ends 24, 26, respectively, of the storage bin 12 may be generally semi-circular or rounded to accommodate the round shape of typical pizza dough. However, the storage system 10 is not limited to this configuration and may have squared or other shaped first and second ends 24, 26 in other embodiments.

It should be appreciated that while the present disclosure may discuss utilizing the storage system 10 in the context of food, or more specifically pizzas and pizza dough 22, the features of the present system are not so limited, and one or more combinations of disclosed features may be beneficially implemented for storing any other potential items. However, the present disclosure may discuss the storage system 10, for the purposes of general understanding by example, in implementations for tempering pizza dough 22. For example, in the food service industry, food items, such as pizza dough 22, may be delivered or stored in a frozen state. Prior to preparation, the pizza dough 22 may require tempering. Tempering numerous pieces of pizza dough 22 may require many hours and tempering times may be inconsistent. However, restaurants may desire for numerous pieces of pizza dough 22 to be tempered sooner rather than later and for all the pieces of pizza dough 22 to be uniformly tempered within the desired time-frame. This is merely one example of an application where the storage system 10 may be used.

Although the sizes of pizzas and pizza dough 22 vary widely, for purposes of this disclosure, exemplary dough for small pizzas may be around 5.6" in diameter, while exemplary medium and large pizzas may be around 8" and 9.5" in diameter, respectfully. The storage system 10 may be generally sized to accommodate two (2) medium or large pizzas or pizza doughs 22 positioned side-by-side in the bin bottom 18 substantially as shown in FIG. 6. Using these exemplary pizza sizes, the storage system 10 may accommodate four (4) small pizzas doughs positioned side-by-side in the bin bottom 18. The thickness of pizza dough may similarly vary between around a half an inch (½") or less to several inches or more in thickness depending the overall size of the pizza as well as the type of pizza, for example thicker so-called "hand-tossed" pizza dough. In the present embodiment, a height 28 of the outer wall 16 between the bin bottom 18 and a bin top 29 may be sized to accommodate from one to six (1-6), or more preferably around three to four (3-4) pizzas or pizza doughs 22 stacked one on top of the other. Separating or spacing material, such as paper, may be used between the stacked pizza dough 22 for various reasons, such separation as to maintain the uniformity of the pieces. When so arranged, the storage system 10 may accommodate, for example, around six (6) or so medium or large pieces and around 12 or so small pieces of pizza dough 22. As such, in this embodiment, the overall length of the storage bin 12 between the first end 24 and the second end 26 of the storage bin 12 is approximately about 20.3" or so, the overall width of the storage bin 12 between a first side 25 and a second side 27 of the storage bin 12 is approximately about 10.4" or so, and the overall height 28 of the storage bin 12 between the bin bottom 18 and the bin top 29 of the storage bin 12 is approximately about 4.9" or so. These dimensions are exemplary and may or may not include the lid 14. However, the present disclosure is not limited to these storage bin 12 sizes and the storage bin 12, in other embodiments, may be sized as desired to accommodate any other numbers or different sizes of pizza or pizza dough 22 or different items.

The storage bin 12 may be provided with a plurality of legs 30 on an underside 32 of the bin bottom 18. Although six (6) legs 30 are shown, more or fewer legs may be used in other embodiments. Legs 30 may be useful for a variety of reasons, for example, to enable air to circulate underneath the storage bin 12. As mentioned above, pizza dough 22 may be in a frozen state and need to be tempered. When pizza dough 22 is positioned in storage area 20 of the storage bin 12, as discussed above, the lowest most pizza dough 22 contacts the bin bottom 18. Air circulating underneath the underside 32 of the bin bottom 18 promotes heat transfer through the bin bottom 18, as well as elsewhere, and tempering of the pizza dough 22 stored therein. As can be seen, the outer wall 16 and bin bottom 18 are solid uniform construction such that when provided with the lid 14, the items stored in the storage area 20 are not subject to air flow. This may be useful to prevent items, such as pizza dough 22, from drying out or otherwise being exposed to unnecessary air flow during tempering. However, in other embodiments where air flow is desired, slots or openings may be provided in various locations in the storage bin 12 and lid 14.

The legs 30 are "X" or cross-shaped in the present embodiment. The "X" shape of the legs 30 may also enhance cleanability. For example, rounded legs might create crevices that are difficult to clean and manufacture via injection molding. Further the "X" shape of the legs 30 ease manufacturing and enhance strength. In circumstances where the storage systems 10 are located on uneven or inconsistent surfaces, such as wire shelves, the cross-shaped configuration may prevent the legs 30 from slipping through gaps in the surface and to facilitate sliding or moving the storage system 10 on such shelves. For example, where the wire in wire shelves are spaced one inch (1") apart, each of the legs 30 may be several or more inches in length across a leg bottom 31 in those embodiments. The legs 30 may be spaced apart on the bin bottom 18 so as to allow for a person's hand to hold the storage bin 12 from the bin bottom 18 between the legs 30. Further, a bottom leading edge 34 of the legs 30 may be rounded or curved to further facilitate the smooth movement of the storage system 10 across surfaces. While the legs 30 are shown cross-shaped in this embodiment, square, round, or other shapes and sizes of legs 30 may be used in other embodiments.

Figure 7:
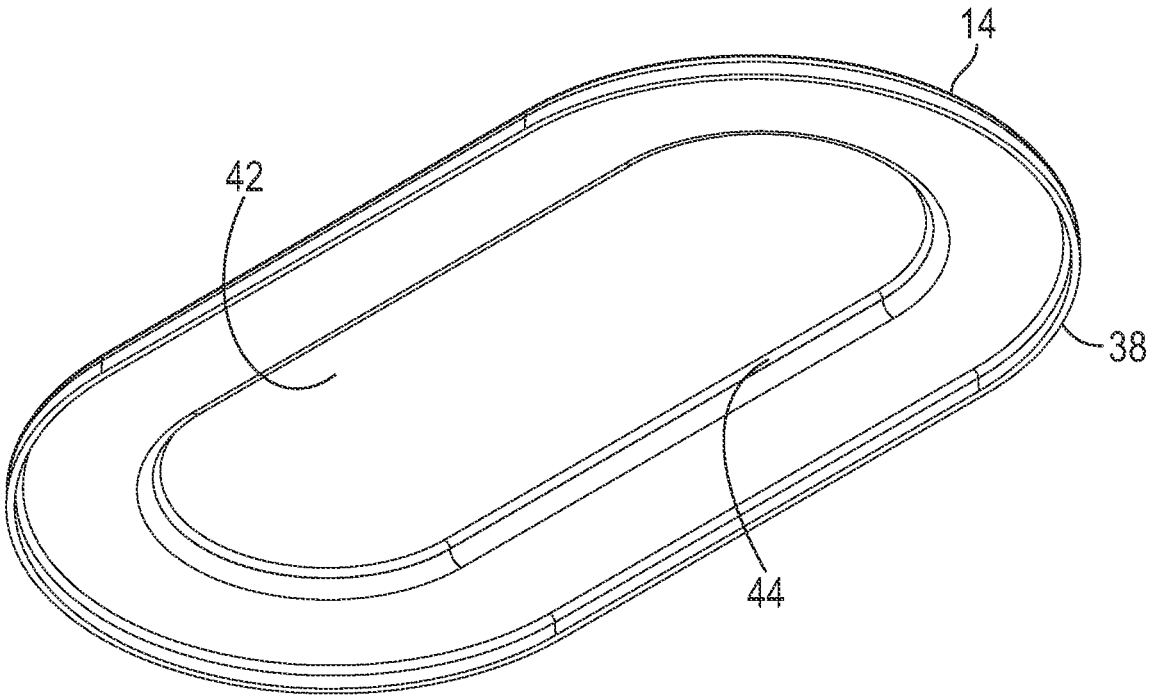
FIG. 7 is a bottom perspective view of the lid according to one embodiment of the present disclosure.
Figure 8:
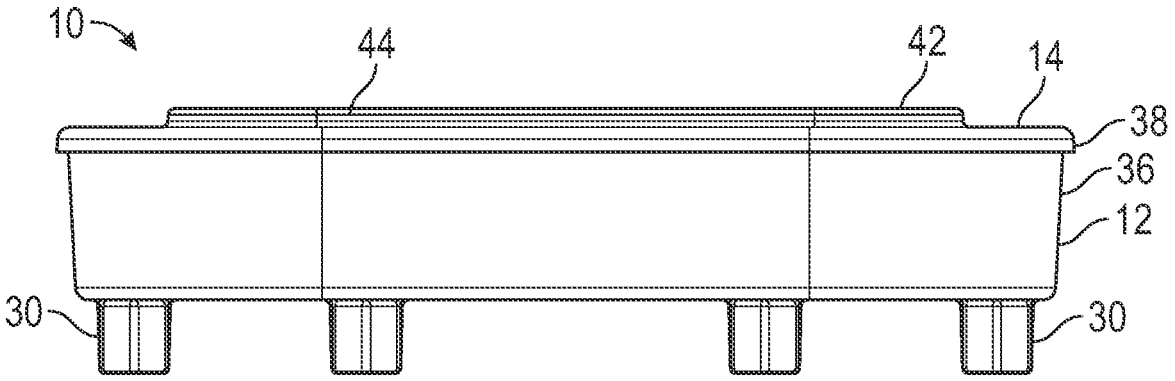
FIG. 8 is a side view of the storage bin with the lid according to one embodiment of the present disclosure.
Figure 9:
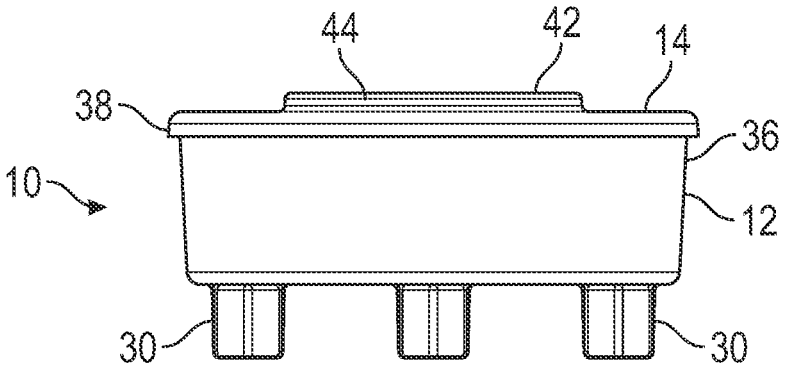
FIG. 9 is a front view of the storage bin with the lid according to one embodiment of the present disclosure.

Referring also to FIGS. 7-9, the lid 14 is configured to conform to an upper part 36 of the outer wall 16. As shown in the present embodiment, the lid 14 may be provided with a skirt 38 that provides an over-lid design that goes over and around the upper part 36 around an outside 40 of the outer wall 16 of the storage bin 12. The skirt 38 configuration provides for attachment of the lid 14 to the storage bin 12 and also prevents liquid or other materials from entering the storage area 20. The lid 14 also includes a raised edge 44 that creates a raised central portion 42 that forms a top-hat design. The raised central portion 42 is sized so that when multiple storage systems 10 are stacked one on top of another, the legs 30 of the upper storage system 10 nest over and around the raised central portion 42 of the lid 14 of the lower positioned storage system 10. Since the storage systems 10 may be carried or moved, as well as stored, the top-hat design of the lid 14 enables multiple storage systems 10 to be carried, moved, or stored without sliding off of one another. Further, the additional height provided by the top-hat design also enable more internal storage space within the storage system 10. Further, the cross-shaped design of the legs 30 further provides uniform engagement of the legs 30 with the raised edge 44 of the raised central portion 42. As discussed above, the bottom leading edge 34 of the legs 30 may be rounded or curved to promote sliding or moving the storage system 10, however, the bottom leading edge 34 curve is not exaggerated, in this embodiment, to enable the legs 30 to securely nest with the top-hat design of the lid 14.

In embodiments, where the storage system 10 is used to temper pizza dough 22, the storage system 10 may be loaded with pizza dough 22 and moved and stored in refrigerators or walk-in coolers for tempering. To conserve space, which may be at a premium in restaurants and walk-in coolers or refrigeration systems, stacking multiple storage systems 10, for example, two (2) to four (4) or more stacked one on the other, may conserve space. However, during tempering, condensation may develop on the storage systems 10. The over-lid design of the skirt 38 prevents condensation from entering the storage area 20 and instead drips down over the outside of the storage bin 12, which may be useful for food quality and safety or otherwise protecting items stored therein.

Figure 10:
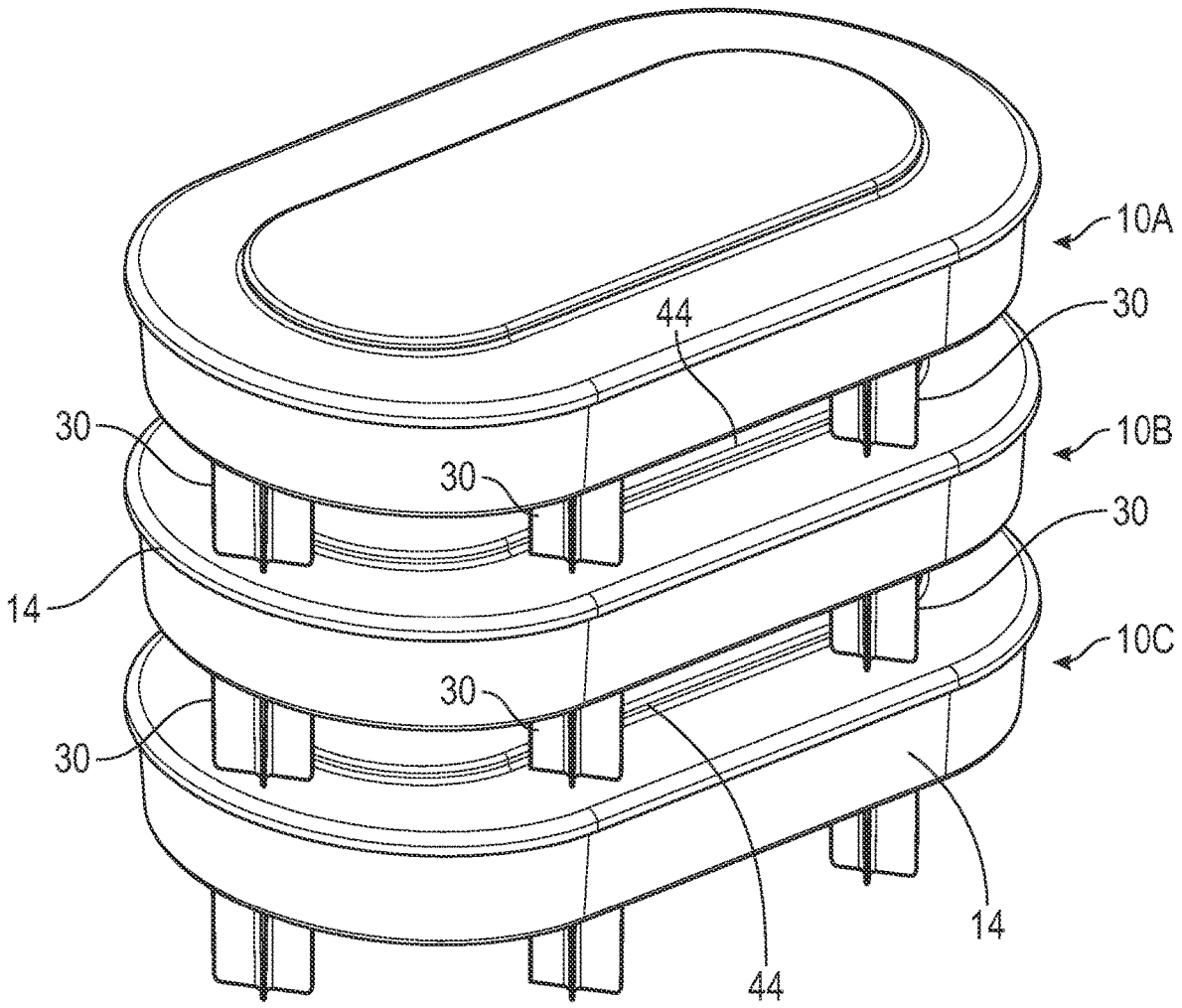
FIG. 10 is a perspective view of multiple stacked storage bins according to one embodiment of the present disclosure.

FIG. 10 illustrates multiple storage systems 10A, 10B, and 10C stacked one on top of another. As can be seen, the legs 30 of storage system 10A and 10B nest with the raised edge 44 of the lid 14 of storage system 10B and 10C, respectively. When stacked, the legs 30 of the storage systems 10A, 10B, and 10C allow for air to circulate above and below each of the storage systems 10A, 10B, and 10C. Further, the engagement of the legs 30 with the raised edge 44 of the lid 14 allows for the storage systems 10A and 10B to stay securely positioned above storage systems 10B and 10C, respectively.

The storage system 10 may be sized, such as discussed above, to one or more storage systems 10 fit into a commercial dishwasher at one time, since the storage system 10 may require frequent cleaning for food safety or other reasons. The storage system 10 may be constructed by injection molding using high density polyethylene in this embodiment, however the storage system 10 may be constructed using other methods and materials in other embodiments.

The open access provided by the storage bin 12 allows for restaurant staff to quickly load multiple pieces of pizza dough 22 into the storage area 20. Also, as discussed above, the legs 30 allow for air to flow underneath the storage systems 10 whether located on a shelf or surface or stacked one on top of another, which provides for quicker and more consistent tempering times for all the pizza dough 22 located in the storage system 10 as compared to other systems that are not configured to promote airflow underneath the system.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

What is claimed is:

1. A storage system, comprising:

a bin having a pair of opposing semicircular ends connected by a pair of substantially parallel elongated edges and having a bottom and an outer wall adjacent and extending from an outer edge of the bottom, the bottom and the outer wall defining an inner storage area, the bin having a plurality of legs located on a lower side of the bottom of the bin, with a first pair of the plurality of legs positioned at opposite ends of a central longitudinal axis of the bin and a second pair of the plurality of legs positioned at opposite ends of a lateral axis of the bin; and a lid having:

a substantially flat portion defining an outer edge of the lid;

a raised top-hat portion having a raised edge leading to a raised central portion, the raised top-hat portion positioned within a perimeter of the substantially flat portion and extending upward relative to an upper surface of the lid, and a skirt extending outward and downward from the outer edge of the lid, the lid sized such that the skirt extends over the outer wall of the bin when the lid is placed on the bin, wherein the plurality of legs of the bin are configured to engage with another lid disposed beneath the bin and the legs, the another lid having a substantially flat portion defining an outer edge of the another lid and a raised top-hat portion having a raised edge leading to a raised central portion, the plurality of legs positioned on the lower side of the bottom of the bin such that the plurality of legs at least partially surround the raised edge of the raised top-hat portion of the another lid such that a bottom surface of the plurality of legs of the bin rest on the flat portion of the another lid and a side surface of the plurality of legs of the bin abut the raised edge of the raised top-hat portion of the another lid when the bin is placed on the another lid; and wherein the plurality of legs of the bin are sized such that the raised top-hat portion of the another lid and the lower side of the bottom of the bin are spaced apart when the bin is placed on the another lid, thereby allowing air to circulate underneath the bin.

2. The storage system of claim 1, wherein each of the plurality of legs are "X" or cross-shaped.

3. The storage system of claim 2, wherein the opposite ends of the central longitudinal axis of the bin comprise a first end and a second end and the pair of legs of the plurality of legs comprise a first leg and a second leg, and wherein the first leg of the plurality of legs is provided adjacent the first end of the bottom of the bin, wherein the second leg of the plurality of legs is provided adjacent the second end of the bottom of the bin, and wherein third, fourth, fifth and sixth legs of the plurality of legs are provided at opposite ends of the lateral axis of the bin and within a middle portion of the bottom of the bin, the middle portion of the bottom of the bin being between the first end and the second end of the bottom of the bin.

4. The storage system of claim 3, wherein each leg of the plurality of "X" or cross-shaped legs is connected at a top of each leg to the lower side of the bottom of the bin, and wherein a bottom corner edge of each leg is curved.

5. The storage system of claim 1, wherein the bin and the lid are constructed of polymeric material.

6. The storage system of claim 1, wherein the bin is at least sized to receive two (2) 9.5" round substantially flat food items positioned side-by-side in the bottom of the inner storage area of the bin.

7. The storage system of claim 1, wherein the bin is at least sized to receive six (6) 9.5" substantially round and 1" high substantially flat food items stacked two (2) across by three (3) high side-by-side in the bottom of the inner storage area of the bin.

8. A system, comprising:

a plurality of storage systems including at least a first storage system and a second storage system, each of the plurality of storage systems including:

a bin having a pair of opposing semicircular ends connected by a pair of substantially parallel elongated edges and having a bottom and an outer wall adjacent and extending from an outer edge of the bottom, the bottom and the outer wall defining an inner storage area, the bin having a plurality of legs located on a lower side of the bottom of the bin, with a first pair of the plurality of legs positioned at opposite ends of a central longitudinal axis of the bin and a second pair of the plurality of legs positioned at opposite ends of a lateral axis of the bin; and a lid having:

a substantially flat portion defining an outer edge of the lid;

a raised top-hat portion having a raised edge leading to a raised central portion, the raised top-hat portion positioned within a perimeter of the substantially flat portion and extending upward relative to an upper surface of the lid; and a skirt extending outward and downward from the outer edge of the lid, the lid sized such that the skirt extends over the outer wall of the bin when the lid is placed on the bin, wherein the plurality of legs of the bin are positioned on the lower side of the bottom of the bin such that the plurality of legs of either the first storage system or the second storage system at least partially surround the raised edge of the raised top-hat portion of the lid of the other of the first storage system or the second storage system such that a bottom surface of the plurality of legs of either the first storage system or the second storage system rest on the flat portion of the other of the first storage system or the second storage system and a side surface of the plurality of legs of either the first storage system or the second storage system abut the raised edge of the raised top-hat portion of the other of the first storage system or the second storage system when the first storage system or the second storage system is on top of the lid of the other of the first storage system or the second storage system, and wherein the plurality of legs of the bin are sized such that the raised top-hat portion of the lid of the other of the first storage system or the second storage system and the lower side of the bottom of the bin of the first storage system or the second storage system are spaced apart to allow air to circulate between the first storage system and the second storage system.

9. The system of claim 8, wherein each of the plurality of legs of either of the first storage system or the second storage system at least partially abut the raised top-hat portion of the lid of the other of the first storage system or the second storage system.

10. The system of claim 8, further comprising a third storage system of the plurality of storage systems, the third storage system stacked on top of the first and second storage systems such that the plurality of legs of the third storage system at least partially surround the perimeter of the raised top-hat portion of the lid of the first storage system or the second storage system.

11. The system of claim 8, wherein each of the plurality of legs are "X" or cross-shaped.

12. The system of claim 11, wherein the opposite ends of the central longitudinal axis of the bin comprise a first end and a second end and the pair of legs of the plurality of legs comprise a first leg and a second leg, and wherein the first leg of the plurality of legs is provided adjacent the first end of the bottom of the bin, wherein the second leg of the plurality of legs is provided adjacent the second end of the bottom of the bin, and wherein a third, fourth, fifth and sixth legs of the plurality of legs are provided at opposite ends of the lateral axis of the bin and within a middle portion of the bottom of the bin, the middle portion of the bottom of the bin being between the first end and the second end of the bottom of the bin.

13. The system of claim 12, wherein each leg of the plurality of "X" or cross-shaped legs is connected at a top of each leg to the lower side of the bottom of the bin, and wherein a bottom corner edge of each leg is curved.

14. The system of claim 8, wherein the bin and the lid are constructed of polymeric material.

15. The system of claim 8, wherein the bin is at least sized to receive two (2) 9.5" round substantially flat food items positioned side-by-side in the bottom of the inner storage area of the bin.

16. The system of claim 8, wherein the bin is at least sized to receive six (6) 9.5" substantially round and 1" high substantially flat food items stacked two (2) across by three (3) high side-by-side in the bottom of the inner storage area of the bin.

17. The system of claim 8, wherein the bin is configured to receive a plurality dough objects for tempering.

18. The storage system of claim 1, wherein the bin includes one or more openings to allow air to flow into the inner storage area of each of the plurality of storage systems.

19. A tempering system for one or more objects, comprising:

a bin having:

a pair of opposing semicircular ends connected by a pair of substantially parallel elongated edges;

a bottom;

an outer wall adjacent to and extending from an outer edge of the bottom, the bottom and the outer wall defining an inner storage area;

a plurality of legs located on a lower side of the bottom of the bin, with first a pair of the plurality of legs positioned at opposite ends of a central longitudinal axis of the bin and a second pair of the plurality of legs positioned at opposite ends of a lateral axis of the bin; and one or more openings configured to allow air to flow into the inner storage area, thereby promoting a tempering of at least one object stored therein; and a lid having:

a substantially flat portion defining an outer edge of the lid;

a raised portion having a raised edge leading to a raised central portion, the raised portion positioned within a perimeter of the substantially flat portion and extending upward relative to an upper surface of the lid; and a skirt extending outward and downward from the outer edge of the lid, the lid sized such that the skirt extends at least partly over the outer wall of the bin when the lid is placed on the bin;

wherein the plurality of legs of the bin are configured to engage with another lid disposed beneath the bin and the legs, the another lid having a substantially flat portion defining an outer edge of the another lid and a raised portion, the plurality of legs positioned on the lower side of the bottom of the bin such that the plurality of legs at least partially surround the raised edge of the raised portion of the another lid disposed beneath the bin such that a bottom surface of the plurality of legs of the bin rest on the flat portion of the another lid and a side surface of the plurality of legs of the bin abut the raised edge of the raised portion of the another lid when the bin is placed on the another lid; and wherein the plurality of legs are sized such that the raised portion of the another lid and the lower side of the bottom of the bin are spaced apart to allow air to circulate underneath the bin, thereby promoting heat transfer through the bin and the tempering of the at least one object stored therein.

20. The tempering system of claim 19, wherein the opposite ends of the central longitudinal axis of the bin comprise a first end and a second end and the pair of legs of the plurality of legs comprise a first leg and a second leg, and wherein the first leg of the plurality of legs is provided adjacent the first end of the bottom of the bin, wherein the second leg of the plurality of legs is provided adjacent the second end of the bottom of the bin, and wherein a third, fourth, fifth, and sixth legs of the plurality of legs are provided at opposite ends of the lateral axis of the bin and within a middle portion of the bottom of the bin, the middle portion of the bottom of the bin being between the first end and the second end of the bottom of the bin.

* * * * *